US006794618B2

(12) United States Patent
Lemken

(10) Patent No.: US 6,794,618 B2
(45) Date of Patent: Sep. 21, 2004

(54) METHOD FOR ELECTRICAL HEATING OF FURNACES FOR HEAT TREATMENT OF METALLIC WORKPIECES

(75) Inventor: Karl-Heinz Lemken, Kleve (DE)

(73) Assignee: Ipsen International GmbH (DE)

( * ) Notice: Subject to any disclaimer, the term of this patent is extended or adjusted under 35 U.S.C. 154(b) by 0 days.

(21) Appl. No.: 10/293,008

(22) Filed: Nov. 13, 2002

(65) Prior Publication Data

US 2003/0098301 A1 May 29, 2003

(30) Foreign Application Priority Data

Nov. 28, 2001 (EP) ..... 01128278

(51) Int. Cl.[7] ..... H05B 1/02

(52) U.S. Cl. ..... 219/490; 219/486; 219/485; 219/503; 373/18; 110/250

(58) Field of Search ..... 219/490, 494, 219/483, 486, 503, 497, 121.36, 121.59, 121.54, 485; 373/18–22, 100–109; 110/246, 346, 250

(56) References Cited

U.S. PATENT DOCUMENTS 4,425,539 A * 1/1984 Wills ..... 318/771
4,425,658 A * 1/1984 Bretthauer et al. ..... 373/103
4,677,643 A * 6/1987 Dkicks ..... 373/105
5,162,717 A * 11/1992 Tamura ..... 318/778
5,251,231 A 10/1993 Croker et al.
5,566,200 A * 10/1996 Konig et al. ..... 373/82

FOREIGN PATENT DOCUMENTS

| | | |
|---|---|---|
| EP | 0 535 319 | 4/1993 |
| GB | 925238 | 5/1963 |

* cited by examiner

*Primary Examiner*—Mark Paschall
(74) *Attorney, Agent, or Firm*—Cantor Colburn LLP

(57) ABSTRACT

In order to refine a method for electric heating of furnaces for heat treating metallic workpieces, especially vacuum furnaces usable for plasma carburizing or nitriding, in which the heater elements of a furnace are supplied with a heating voltage that is generated in the secondary circuit of a three phase transformer connected to the three phase power network such that a comparatively small reactive power component can be obtained in a simple and economical manner, it is proposed that the primary coil windings of the three phase transformer be switched in the delta connection during a first heating phase and in the star connection during a second heating phase, whereby the switchover time from the delta connection to the star connection is determined as a function of operating parameters characteristic for the heating process.

17 Claims, 6 Drawing Sheets

Figure 1:
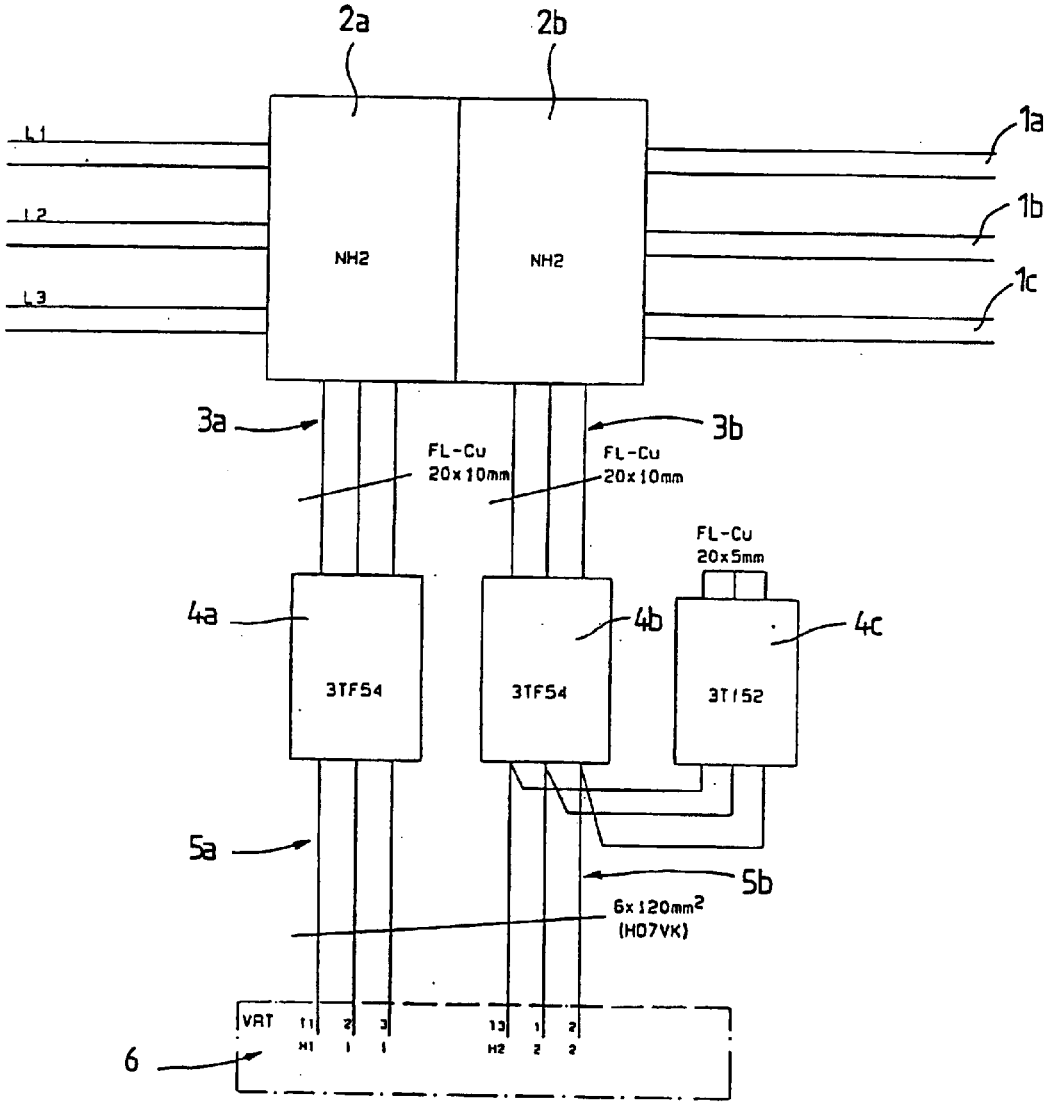

METHOD FOR ELECTRICAL HEATING OF FURNACES FOR HEAT TREATMENT OF METALLIC WORKPIECES

FIELD OF THE INVENTION

The invention concerns a method for electrical heating of furnaces for heat treatment of metallic workpieces, especially for vacuum furnaces usable for plasma carburizing or nitriding, where the heating elements of the furnace are supplied with a heating voltage that is generated on the secondary circuit of a three phase transformer connected to a three phase network.

DESCRIPTION OF THE RELATED ART

Usually a three phase current brought forth by three alternating voltages phase shifted by 120° in relation to one another which, in each case, has a phase shift ($\phi$) between voltage and current depending upon the inductive and/or capacitive characteristics of the user in connection with not purely ohmic electric consumers, thus for electric consumers with circuit elements with inductive and/or capacitive properties.

In three phase networks, only the active power generated by the three phase current is usable in electric consumer-equipment that requires energy to fulfill a task posed by humans. But a reactive power (Q) deriving from the reactive current arises in addition in the three phase network which does not contribute to usable output. The reactive power has its origin in the phase shift between voltage and current that is called forth by inductivities and capacities in the circuit and is used to build up electric and magnetic fields. The reactive power (Q) has an unfavorable effect on electrical equipment as it causes voltage drops and current heat losses and represents an additional burden for generators, transformers and lines. For this reason, maintaining an output factor (cos $\phi$) between 0.8 and 0.9 is required of larger consumers by energy supply businesses. In addition to this, a reactive power payment must be provided. Industrial operations are therefore interested in compensating for the reactive power arising in their networks.

Numerous compensation facilities and devices are known for compensating for reactive power in three phase networks, for example, synchronous compensators, also called phase shifters, reactive power condensers and reactive current rectifiers. These facilities and devices bring about a diminution of the phase angle ($\phi$) between active power (P) and apparent power (S) and therewith a diminution of the reactive power (Q) to be paid for. It is important to avoid the existing expenditures for facilities and equipment that compensate for reactive power when taking into account the lowest possible manufacturing and operating costs, as these are not insignificant in relationship to industrial engineering and are cost intensive from an economic perspective, and thus disadvantageous.

Compensation for reactive power is useful in particular with furnaces for heat treating metallic workpieces, especially for vacuum furnaces used for plasma carburizing or nitriding. In order to avoid ionization of the furnace atmosphere in the area of the heating elements during plasma carburizing or nitriding, known furnaces are provided with heating elements that have low ohmic resistance and are supplied with a low heating voltage. The low ohmic design of the heating elements requires a correspondingly larger quantity of heating elements, which for their part conditions an increased heating output. The increased heating output, as well as the low heating voltage, have (in addition to a considerable industrial engineering and consequently cost-intensive manufacturing expenditure) the result that a current with greater amperage flows through the heating elements, which accordingly entails a high reactive current component and correspondingly high output power (Q).

With three phase transformers, especially in connection with furnaces for heat treating metallic workpieces, for control of heating voltage and therewith of the temperature of variously adjustable reactance transformers, called VRT, the output factor (cos $\phi$) can only be kept in a specific working point or a range of predetermined working points at acceptable values between 0.8 and 0.9. The smallest deviations from the operating point or points of transformers are associated with a high diminution of the output factor (cos $\phi$) and therewith with an increase in the reactive current component and a correspondingly high reactive power (Q). Owing to almost constantly changing operating parameters of the heating process, for example, the furnace temperature, the batch temperature or the requisite heat output in any given case, a deviation from the optimal operating point or the range of operating points and an increase in reactive power (Q) going along with it is in particular associated with variably adjustable reactance transformers (VRTs), which regulate the output transmission from the primary circuit to the secondary circuit of the transformer by means of a manipulated variable based on the characteristic operating parameters for the heating process in furnaces for heat treating metallic workpieces, as empirical studies have shown.

SUMMARY OF THE INVENTION

The disclosure is based upon the objective of refining a method for electrical heating of furnaces for the heat treatment of metallic workpieces of the type mentioned at the beginning such that a comparatively small reactive power component can be obtained in a simple and economical manner.

This objective is accomplished with a method with the features of the invention mentioned at the beginning in that the primary coil windings of the three phase transformer are switched in the delta connection during a first heating phase and in the star connection in a second heating phase, whereby the switchover point from the delta connection to the star connection is determined as a function of the operating parameters characteristic for the heating process.

The invention is based upon the knowledge that the heating process during electrical heating of furnaces for heat treating metallic workpieces includes heating phases that require different heating outputs. Thus, for example, in heating a furnace up to a certain temperature, a greater heat output is necessary than for maintaining the furnace at a processing temperature necessary for the heat treatment required. In accordance with the invention, it is guaranteed that the switchover of the primary coil windings of the three phase transformer from the delta connection to the star connection as a function of the operating parameters characteristic for the heating process that the three phase transformer operates in a working point or a region of working points in which a high output factor (cos $\phi$) exists. Through switching over from delta connection to the star connection, the electrical output fed the three phase transformer on the primary circuit is diminished. Moreover the working point of the three phase transformer is maintained despite the diminution of secondary electrical output power just like the output factor (cos $\phi$) associated with the working point or points, so that a restriction of reactive power is attained without expensive compensation.

In this connection, it is advantageous that the delta connection of the primary coil windings brings about a high heat output in the first heating phase such that a correspondingly short heating time results. After heating up, only a small heat output is still necessary in the second heating phase. According to the invention, the switchover from the delta connection to the star connection is considered a function of the operating parameters characteristic of the heating process and the lower secondary heating voltage associated with it.

Above all, in connection with plasma carburizing or plasma nitriding, the latter leads moreover to avoiding ionization in the furnace atmosphere in the region of the heating elements. Instead of an otherwise necessary compensation of reactive power (Q), the reactive power (Q) otherwise to be compensated for is not generated in the first place owing to the switchover of the invention. Conditioned by the switchover from primary coil windings of the three phase transformer from the delta connection to the star connection, the primary side of the three-phase transformer is impressed with different high conductor voltages and conductor currents, which cause, that on the secondary side the heating voltage generated by the three phase transformer diminishes and a lower heat output is accordingly supplied during the second heating phase. It was established that the reduced electrical heat output in the secondary circuit of the three phase transformer caused by the advantageous switchover from the delta connection to the star connection basically corresponds to the diminished heat output necessary during the second phase for maintaining the operating temperature required for the requisite heat treatment. Advantageously, the time for switching over from the delta connection to the star connection is determined as a function of specifiable manipulated variables, preferably of a variably adjustable reactance transformer.

In an especially advantageous configuration of the invention, the time for switching over from the delta connection to the star connection is determined as a function of furnace temperature and/or batch temperature and/or the output factor (cos ϕ) as operating parameters characteristic of the heating process.

Furthermore, it is advantageous to switch over from the delta connection to the star connection by means of a contactor, since output losses are then kept low and reactive power is considerably diminished.

A preferred configuration of the invention makes use of heating elements with a comparatively high ohmic resistance. This is possible even with plasma carburizing or plasma nitriding as distinct from previous ways of conducting the method because amperage as well as heat output and therewith heat voltage are reduced during the second heating phase owing to the star connection so that (as explained before) the danger of ionization of the furnace atmosphere in the region of the heating element can be ruled out. Through the use of heating elements with a high ohmic resistance, the industrial engineering manufacturing expenditure diminishes as the quantity of heating elements can be reduced and correspondingly the requisite heat output diminishes. In addition, the same heating elements can be used for different types of furnaces so that the additional expenditure previously controlling with furnaces for plasma carburizing or plasma nitriding can be omitted.

In accordance with an advantageous refinement of the invention, a variably adjustable reactance transformer is used as a three phase transformer. In interaction with heating elements having a high ohmic resistance, this offers the advantage that the heating voltage or temperature in the furnace chamber is adjustable by variation of the manipulated variable of a reactance transformer rather than with a contactor. The diminution of the output factor (cos ϕ) usually resulting as a consequence of changing the manipulated variable of a reactance transformer in the direction of smaller values is moreover of subordinate significance owing to the high ohmic character of the resistance of the heating elements. In order to attain a fine adjustment of the heating voltage, it is furthermore proposed that the heat voltage for the first and second heating phase be adapted by varying the manipulated variable of the reactance transformer, notwithstanding the switchover from the delta to the star connection.

Appropriately, during the first heating phase, a heating voltage of less than 60 V, preferably about 50 V, is applied to the heating elements, and during the second heating phase, a heating voltage of less that 35 V, preferably about 30 V. During plasma carburizing or plasma nitriding, a short heating phase is consequently guaranteed in the first heating phase, and in the second heating phase, an impairment of the furnace atmosphere due to undesired ionization in the region of the heating elements is ruled out. Finally, providing a three phase network with a voltage of about 400 V is proposed, so that the operation of a furnace for heat treating metallic workpieces on the public power grid is made possible.

BRIEF DESCRIPION OF THE DRAWINGS

Figure 2:
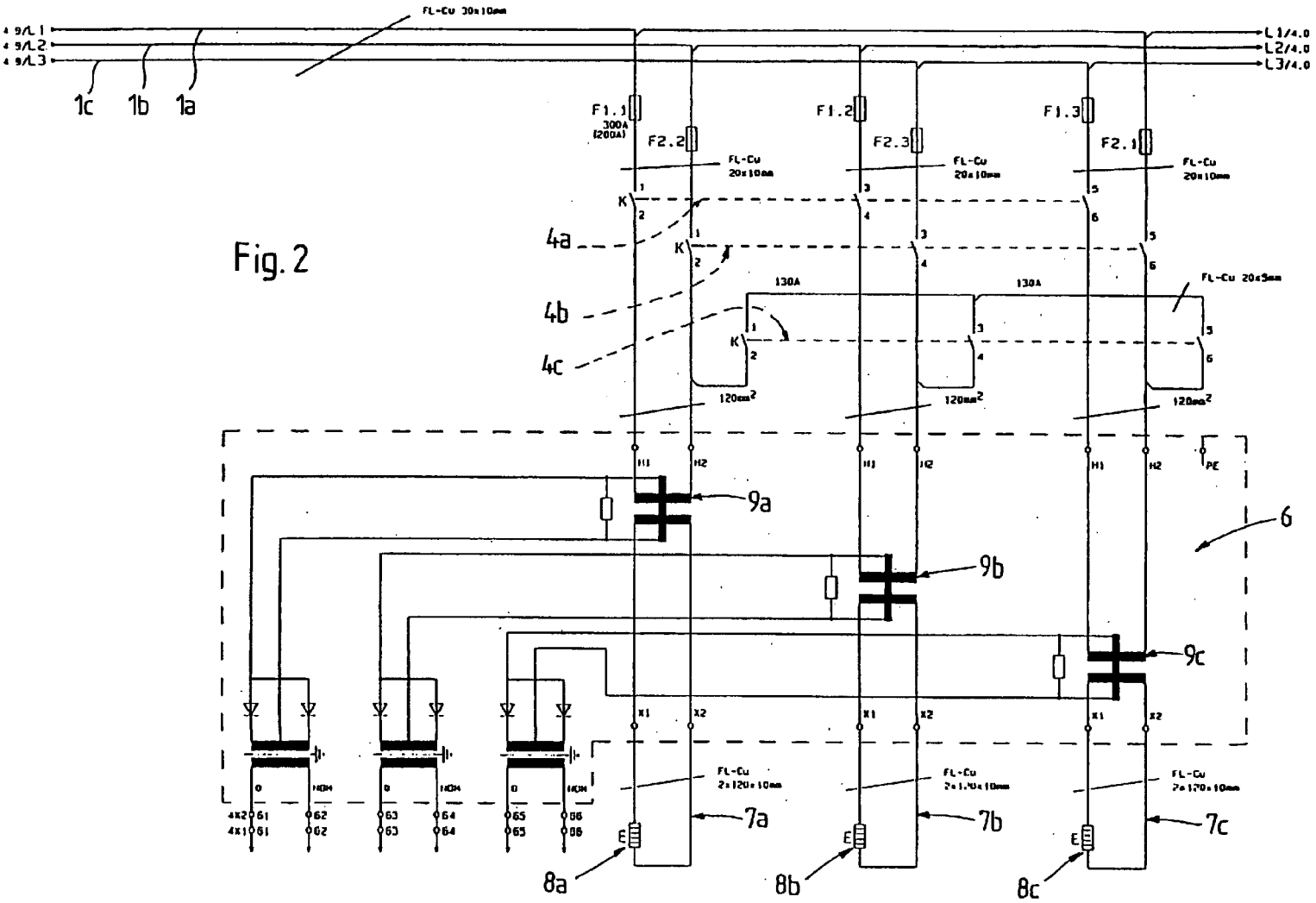
Figure 3:
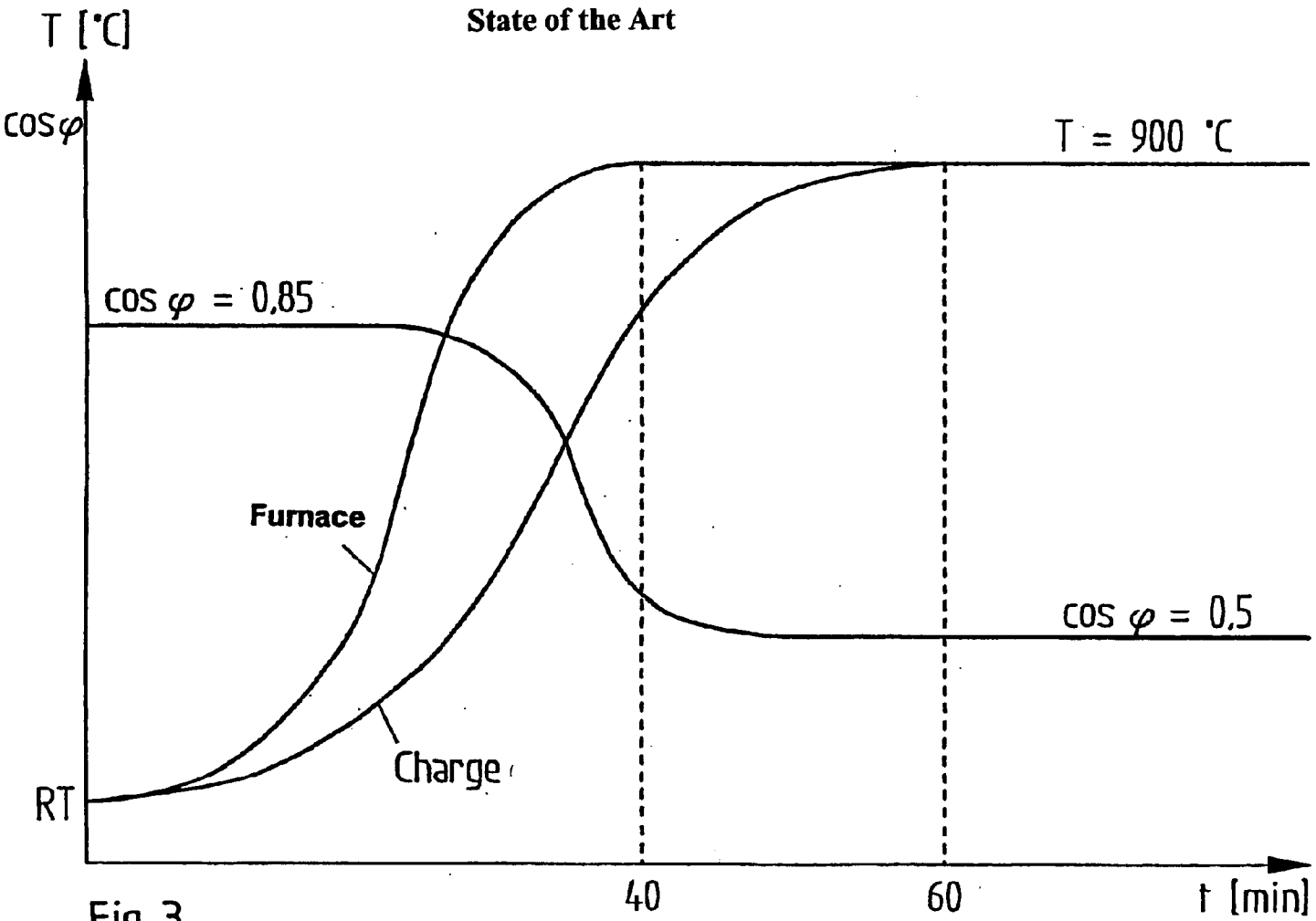
Figure 4:
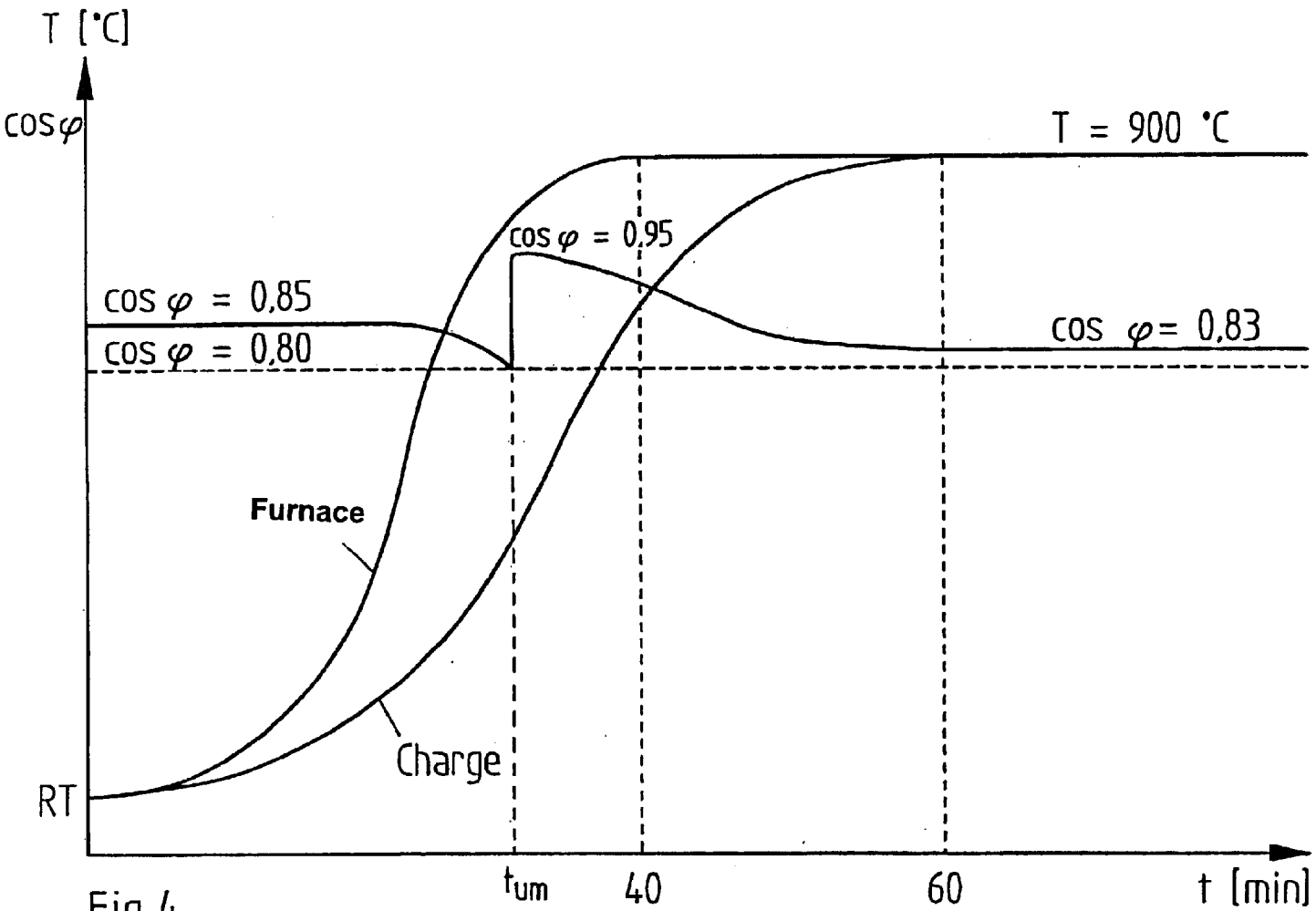
Figure 5:
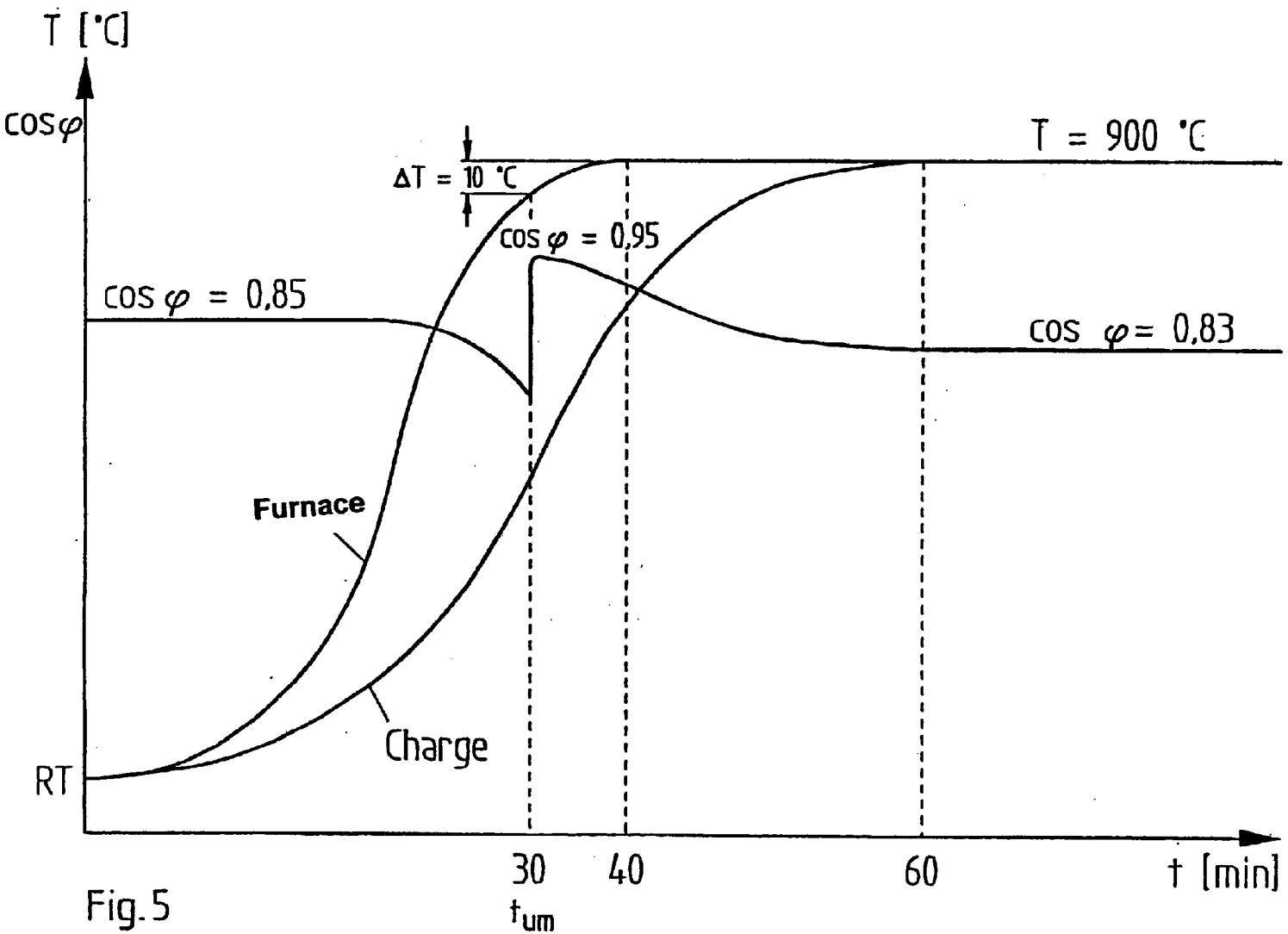
Figure 6:
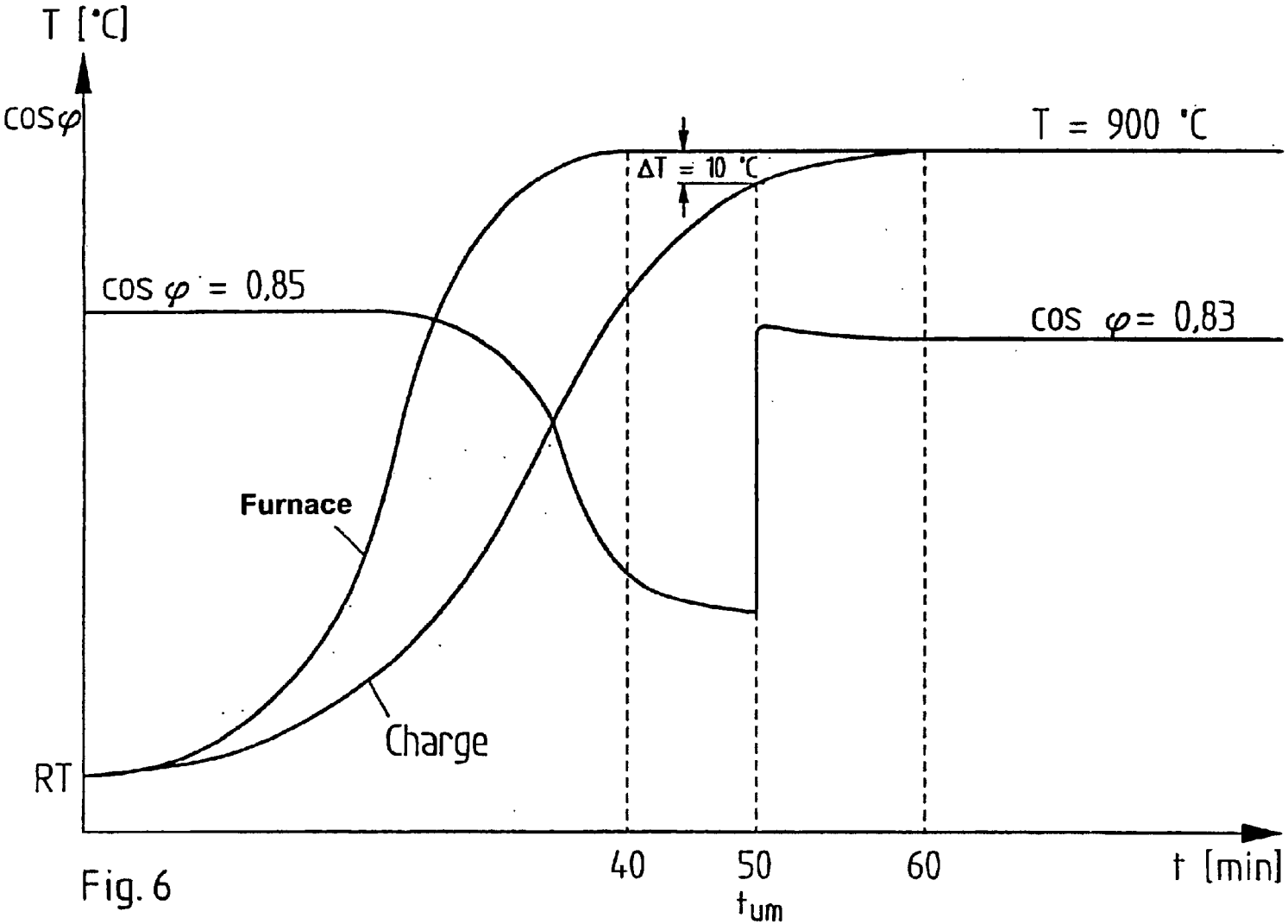

Further details, features and advantages of the invention emerge from the subsequent description of preferred designs. In the associated drawings, there are shown in particular:

FIG. 1 A schematic representation of the circuit diagram of an electrical heating apparatus for a vacuum furnace;

FIG. 2 A detailed representation of the circuit diagram in accordance with FIG. 1;

FIG. 3 The time curve of the output factor (cos ϕ) during the heating process in accordance with the state of the art in a diagram;

FIG. 4 The time curve of the output factor (cos ϕ) of a heating process of the invention with a switchover of the primary coil windings from the delta connection to the star connection as a function of the output factor (cos ϕ) in a diagram;

FIG. 5 The time curve of the output factor (cos ϕ) of a heating process of the invention with a switchover of the primary coil windings from the delta connection to the star connection as a function of furnace temperature in a diagram and FIG. 6 The time curve of the output factor (cos ϕ) of a heating process of the invention with a switchover of the primary coil windings from the delta connection to the star connection as a function of charge temperature in a diagram.

DETAILED DESCRIPTION

The circuit plan represented in FIGS. 1 and 2 shows power strands 1*a*, 1*b*, 1*c* constructed as flat copper lines with a cross section of 30×10 mm of a three phase grid having a grid voltage of about 400 V. The power strands 1*a*, 1*b*, 1*c* are connected with fused interrupters 2*a*, 2*b*, of size NH2 which are secured with 315 A. The fused interrupters 2*a*, 2*b* are connected to a line contactor designed 4*a* for 300 A and a delta contactor 4*b* likewise designed for 300 A or a star contactor 4*c* connected parallel to the latter and designed for 160 A through flat copper lines 3*a*, 3*b* having a cross section of 20×10 mm. Flat copper lines 5*a*, 5*b* with a cross section of 6×120 $mm^2$ connect the contactors 4*a* through 4*c* with the primary coil windings of a variably adjustable reactance transformer 6. As can be particularly recognized on the basis of FIG. 2, the secondary coil windings of the reactance transformers 6 are joined through flat copper leads 7*a*, 7*b*, 7*c* of thickness 2×120×10 mm to heating elements 8*a*, 8*b*, 8*c* with a high ohmic resistance.

The primary coil windings of reactance transformer 6 are linked according to the process condition of a heat treatment conducted in the vacuum furnace either in a delta connection or in a star connection. A switchover from the delta connection to the star connection can take place through connector 4*b*, 4*c*. In the case of delta connection, a conductor voltage of about 400 V is applied on the primary circuit of reactance transformer 6. The current flowing through the primary coil windings of the reactance transformers 6 moreover has an amperage of about 464 A. In the case of the star connection, a lower conductor voltage of about 230 V is applied on the primary circuit of reactance transformer 6. The size of the primary current is likewise lower and comes to about 268 A.

Through individual transformers 9*a*, 9*b*, 9*c* of reactance transformer 6 transmitting an apparent power of 118 kVA in each case, the conductor voltage applying to the primary circuit of reactance transformer in any given case is transformed downward, in the case of the star connection, for example, to a heating voltage of about 35 V dropping on the secondary circuit of the reactance transformer. With a secondary current of an amperage of 3057 A, there results in this way an active power of about 107 kW in each case for heating elements 8*a*, 8*b*, 8*c*.

The heating apparatus based on the previously depicted circuit plan makes it possible for the furnace chamber of the vacuum furnace to be heated to a specific temperature, about 1080° C. during a first heating phase, for example, for plasma nitriding of metallic workpieces, and during a second heating phase to a nitriding temperature corresponding to the respective use of, for example, 600° C. to 850° C. for a specified duration. During the first heating phase, the primary coil windings of reactance transformer 6 are linked in the delta connection such that a short heating up time results on the basis of the high heat output furnished for heating elements 8*a*, 8*b*, 8*c*. Upon reaching the specified temperature at the end of the first heating phase, a switchover to the star connection takes place using contactor 4*c*, owing to which the secondary current as well as the heating voltage dropping off in the secondary circuit.

Since a smaller heat output is necessary for maintaining the temperature during the second heating phase, a sufficient heating output is made available through the reduced heating voltage. A noticeable change of the manipulated variable of reactance transformer 6 is not needed for adapting the heat output, since this is operated further in its working point or in the region of its specified working points. The reactance transformer 6 can nonetheless be relied upon for fine adjustment of heat output. Moreover, a significant diminution of the output factor (cos ϕ) is omitted. In this way, a small reactive current component is allowed for which makes an expensive reactive current compensation unnecessary and not least reduces the energy costs accruing. The high ohmic resistance of heating elements 8*a*, 8*b*, 8*c* supports this.

FIG. 3 depicts the time curve of the output factor (cos ϕ) during a heating process in accordance with the state of the art. Furnace and charge are heated from room temperature (about 20° C.) to a temperature of 900°. It can be recognized on the basis of the temperature curve of furnace and charge that the charge follows the temperature curve. During heating up, the reactance transformer 6 is still situated in its working point which has an output factor of cos ϕ=0.85. As can be recognized on the basis of FIG. 3, the working point of the reactance transformer changes during heating up with the consequence that the output factor cos ϕ drops to a value of cos ϕ=0.5. With the drop of the output factor cos ϕ, the reactive current component and therewith reactive power Q moreover increase in an undesirable manner.

FIG. 4 depicts the time curve of the output factor cos ϕ for the heating process in accordance with FIG. 3 during heating of a furnace and a batch from room temperature (about 20° C.) to a processing temperature of 900° C. With the design in accordance with FIG. 4, the switchover point of the primary coil windings of reactance transformer 6 from the delta connection to the star connection is determined as a function of output factor cos ϕ. The switchover time $t_{um}$ is presently specified as a function of a specified output factor cos ϕ of 0.80 which cannot be undershot. When heating up the furnace and the charge, the working point of reactance transformer 6 changes, owing to which the output factor cos ϕ having a value of 0.85 at the beginning of the heating process gradually drops. Upon reaching and/or undershooting an output factor cos ϕ of 0.80, the primary coil windings of reactance transformer 6 are switched from the delta connection to star connection. By switching over from the delta connection to the star connection, the reactance transformer takes up a lesser electrical output from the three phase network. Correspondingly, the secondary electrical heating voltage is reduced, and therewith the heat output and the output factor cos ϕ increases to a value of 0.95, corresponding to a reduced reactive power Q. Moreover, the reactance transformer operates in its working point, apart from minor deviations. The reduced secondary heat output furthermore suffices for the heat output necessary for maintaining or slight rises in furnace or charge temperature for the heat treatment of metallic workpieces taking place in the second heating phase. After switching over from the delta connection to the star connection, the output factor cos N gradually assumes an output factor cos ϕ with a stable value of cos ϕ=0.83 from the output factor ϕ=0.95 existing at the switchover time.

The switchover time $t_{um}$ of the primary coil windings of reactance transformer 6 from the delta connection to the star connection correspondingly represents a power cost-saving measure as a function of attaining a specified output factor cos ϕ,.

FIG. 5 shows the time curve of output factor cos ϕ for the heating process of a furnace or a batch from room temperature (about 20° C.) to a processing temperature of about 900° C. The switchover time of the primary coil windings of reactance transformer 6 from the delta connection to the star connection is moreover determined as a function of a specifiable change in furnace temperature. Furthermore, the change in furnace temperature over time is ascertained and a switchover from the delta connection to the star connection takes place upon reaching a specifiable temporal change in temperature. At the switchover time, the output factor cos ϕϵ which had fallen from a value of 0.85 during heating up to a value below 0.80, rises to a value of 0.95 and is stabilized during the second heating phase to a value of 0.83.

FIG. 6 shows the time curve of output factor cos ϕ for the corresponding heating process of a furnace or a batch from room temperature (about 20°) to a temperature of 900° C.

With the design in accordance with FIG. 6, the switchover time $t_{um}$ of the primary coil windings of reactance transformer 6 from the delta connection to the star connection is determined as a function of the change of the charge temperature over time. Upon reaching a temporal change of batch temperature of $\delta$ t=10° C., the primary coil windings of reactance transformer 6 are switched over from the delta connection to the star connection. The output factor cos $\phi$ which fell during the first heating phase from an output factor cos $\phi$=0.85 to a value below 0.80 suddenly rises at the time of switching over $t_{um}$ to an output factor cos $\phi$ of about 0.85 and stabilizes during the second heating phase at an output factor cos $\phi$=0.83.

Through the automatic switching over of the invention of the interconnection of the primary coil windings from the delta connection to the star connection as a function of operating parameters characteristic for the heating process in accordance with FIG. 4 as a function of output factor cos $\phi$, in accordance with FIG. 5 as a function of furnace temperature and in accordance with FIG. 6 as a function of the change over time of the batch temperature, a comparatively smaller reactance power component can be attained in a simple and economical manner without expensive reactive output compensation devices. The switching over point of the primary coil windings of the reactance transformer from the delta connection to the star connection is moreover adaptable to individual needs of the heating process over wide areas.

The designs represented in the Figures merely serve to explain the invention and are not restrictive for this.

What is claimed is:

1. Method for electrical heating of furnaces for heat treating of metallic workpieces, in which heating elements of a furnace are supplied with a heating voltage that is generated on a secondary circuit of a three phase transformer connected to a three phase power network, the method comprising:

switching primary coil windings of a three phase transformer in a delta connection in a first heating phase and in a star connection in a second heating phase, wherein a switchover time from the delta connection to the star connection is determined as a function of operating pammeters characteristic for a heating process.

2. Method according to claim 1, further comprising determining the switchover time from delta to the star connection as a function of a specifiable manipulated magnitude.

3. Method according to claim 1, further comprising determining the switchover time from the delta connection to the star connection as a function of a specifiable output factor (cos N).

4. Method according to claim 3, wherein upon reaching or undershooting an output factor cos N of 0.80, the switchover from the delta connection to the star connection takes place.

5. Method according to claim 1, further comprising determining the switchover time from the delta connection to the star connection as a function of furnace temperature.

6. Method according to claim 5, wherein the switchover from the delta connection to the star connection occurs as a function of a change in furnace temperature over time.

7. Method according to claim 1, further comprising determining the switchover time from the delta connection to the star connection as a function of charge temperature.

8. Method according to claim 7, wherein the switchover from the delta connection to the star connection takes place as a function of a change of batch temperature over time.

9. Method according to claim 1, further comprising heating up the furnace to a certain temperature during the first heating phase; and maintaining the furnace at a processing temperature necessary for a requisite heat treatment during the second heating phase.

10. Method according to claim 1, wherein the switchover from the delta connection to the star connection takes place using a contactor.

11. Method according to claim 1, wherein the heating elements used have a high ohmic resistance.

12. Method according to claim 1, further comprising using a variably adjustable reactance transformer as a three phase transformer.

13. Method according to claim 12, further comprising adapting the heating voltage for the first and second heating phase by varying a manipulated variable of the reactance transformer.

14. Method according to claim 1, wherein during the first heating phase, a heating voltage of less than 60 volts V, and during the second heating phase, a heating voltage of less than 35 volts V. is applied to the heating elements.

15. Method according to claim 1, further comprising using a three phase power grid with a voltage of about 400 volts V.

16. Method according to claim 15, wherein the furnaces are vacuum furnaces usable for plasma carburizing or nitriding.

17. Method according to claim 14, wherein during the first heating phase, a heating voltage of about 50 volts V. and during the second heating phase, a heating voltage of about 30 volts V. is applied to the heating elements.

* * * * *